US010008157B2

(12) United States Patent
Kim et al.

(10) Patent No.: US 10,008,157 B2
(45) Date of Patent: Jun. 26, 2018

(54) DISPLAY DEVICE HAVING POWER SUPPLY WITH VARYING OUTPUT VOLTAGE AND DRIVING METHOD THEREOF

(71) Applicant: LG DISPLAY CO., LTD., Seoul (KR)

(72) Inventors: Jungjae Kim, Goyang-si (KR); Jaewon Han, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 5 days.

(21) Appl. No.: 14/973,043

(22) Filed: Dec. 17, 2015

(65) Prior Publication Data

US 2016/0189631 A1 Jun. 30, 2016

(30) Foreign Application Priority Data

Dec. 24, 2014 (KR) ..... 10-2014-0188914

(51) Int. Cl.

| | |
|---|---|
| ***G09G 3/30*** | (2006.01) |
| ***G09G 3/3291*** | (2016.01) |
| ***G09G 3/3225*** | (2016.01) |
| ***G09G 3/3266*** | (2016.01) |

(52) U.S. Cl.

CPC ..... *G09G 3/3291* (2013.01); *G09G 3/3225* (2013.01); *G09G 3/3266* (2013.01); *G09G 2310/0278* (2013.01); *G09G 2320/0209* (2013.01); *G09G 2320/0223* (2013.01); *G09G 2320/0233* (2013.01); *G09G 2330/025* (2013.01); *G09G 2330/028* (2013.01); *G09G 2360/16* (2013.01)

(58) Field of Classification Search

CPC ..... G09G 1/005; G09G 2330/00–2330/12; G09G 2360/08

See application file for complete search history.

(56) References Cited

U.S. PATENT DOCUMENTS

| | | | | |
|---|---|---|---|---|
| 2004/0227749 | A1* | 11/2004 | Kimura | G09G 3/3233 345/211 |
| 2006/0061291 | A1* | 3/2006 | Lee | G09G 3/3233 315/169.3 |
| 2006/0125744 | A1* | 6/2006 | Klein | G09G 3/3216 345/82 |
| 2008/0042592 | A1* | 2/2008 | Ashdown | H05B 33/089 315/250 |
| 2009/0058324 | A1* | 3/2009 | Nakao | G05F 1/56 315/307 |
| 2010/0073265 | A1* | 3/2010 | Hirai | G09G 3/3241 345/55 |
| 2011/0115832 | A1 | 5/2011 | Lee et al. | |
| 2012/0287109 | A1* | 11/2012 | Chang | G09G 3/3696 345/212 |
| 2012/0327063 | A1 | 12/2012 | Izawa et al. | |
| 2013/0169697 | A1* | 7/2013 | Park | G09G 3/2003 345/690 |

* cited by examiner

*Primary Examiner* — Sanghyuk Park

(74) *Attorney, Agent, or Firm* — Dentons US LLP

(57) ABSTRACT

Provided is a display device that includes, for example, a display panel, a driver, a power supply unit, and a timing controller. The power supply unit may supply a voltage to the driver. The power supply unit may perform a compensation operation to vary an output voltage output from the power supply unit itself to correspond to a variation of a load before the load varies.

9 Claims, 6 Drawing Sheets

DISPLAY DEVICE HAVING POWER SUPPLY WITH VARYING OUTPUT VOLTAGE AND DRIVING METHOD THEREOF

This application claims the benefit of Korean Patent Application No. 10-2014-0188914, filed on Dec. 24, 2014, which is incorporated herein by reference for all purposes as if fully set forth herein.

BACKGROUND OF THE INVENTION

Field of the Invention

The present disclosure relates to a display device and a method of driving the same, and more particular, to a display device with improved image quality.

Discussion of the Related Art

As the information technology has advanced, the market of display devices as a medium for connecting users and information has grown. In line with this trend, the use of display devices such as organic light emitting display (OLED) devices, liquid crystal display (LCD) devices, and plasma display panel (PDP) devices has increased.

Some of these display devices, for example, LCD devices or OLED devices have a display panel that includes a plurality of sub-pixels disposed in a matrix form, a driver driving the display panel, and a timing controller controlling the driver. The driver typically includes a scan driver for supplying a scan signal (or a gate signal) to the display panel and a data driver for supplying a data signal to the display panel.

These display devices display a specific image as the display panel emits light or allows light to be transmitted therethrough on the basis of a voltage output from a power supply unit in accordance with the scan signal and the data signal output from the scan driver and the data driver.

In the related art display device, when a voltage output from the power supply unit fluctuates significantly due to a variation in the load and when the degree of the voltage fluctuation differs depending on the variation of the load, a horizontal crosstalk (X-talk) or an abnormal image may appear on the display panel. In particular, when a large number of thin film transistors (TFTs) are formed for each sub-pixel, as in the case of an OLED device, it may be difficult to predict an amount of such a horizontal crosstalk generated in the display panel.

SUMMARY OF THE INVENTION

Accordingly, the present invention is directed to provide a display device and a method of driving the same that substantially obviate one or more problems due to limitations and disadvantages of the related art.

An advantage of the present invention is directed to provide a display device with improved image quality.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device may, for example, include a display panel, a driver, a power supply unit, and a timing controller. The display panel may display an image. The driver may include a data driver and a scan driver driving the display panel. The power supply unit may supply a voltage to the driver. The power supply unit may perform a compensation operation to vary an output voltage output from the power supply unit itself to correspond to a variation of a load before the load varies.

In another aspect of the present disclosure, a method of driving a display device may, for example, include analyzing and predicting an output current amount according to a data signal; analyzing a transient current amount of an output voltage according to the output current amount; determining a variation of the output voltage according to the transient current amount; defining a generation section of the transient current on a basis of the variation of the output voltage; and varying an output voltage of a power supply unit before the transient current is generated.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings.

A display device according to an embodiment of the present disclosure can be implemented as a television, a set-top box (STB), a navigation device, a video player, a Blu-ray player, a personal computer (PC), a home theater, a mobile phone, or the like. As a display panel of such a display device, a liquid crystal display panel, an organic light emitting display panel, an electrophoretic display panel, or a plasma display panel can be used, but the present disclosure is not limited thereto. By way of example, an organic light emitting display (OLED) device will now be described as a display device according to an embodiment of the present disclosure.

Figure 1:
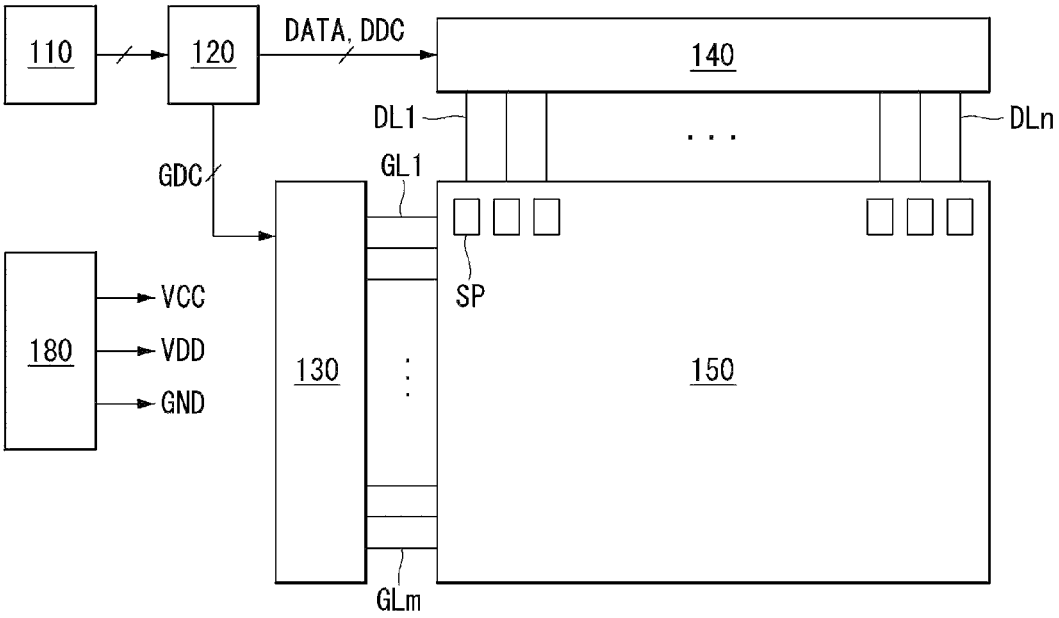
FIG. 1 is a block diagram schematically illustrating a display device according to an embodiment of the present disclosure.
Figure 2:
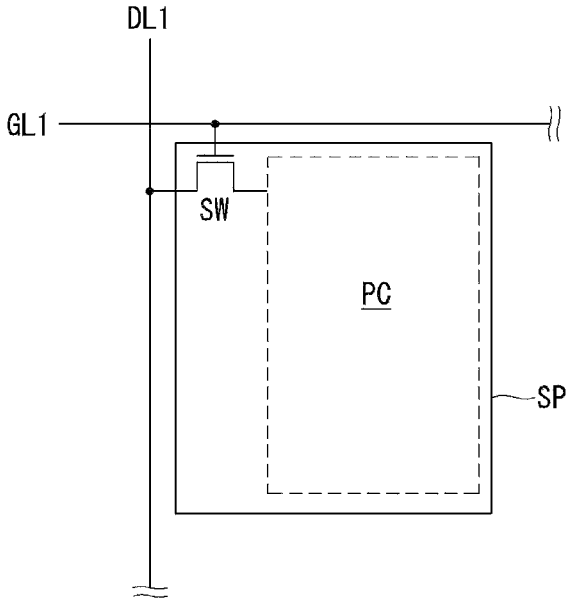
FIG. 2 is a view schematically illustrating a sub-pixel of the display device illustrated in FIG. 1.

FIG. 1 is a block diagram schematically illustrating a display device according to an embodiment of the present disclosure, and FIG. 2 is a view schematically illustrating a sub-pixel of the display device illustrated in FIG. 1.

As illustrated in FIG. 1, the display device includes an image supply unit 110, a timing controller 120, a scan driver 130, a data driver 140, a display panel 150, and a power supply unit 180.

The image supply unit 110 processes a data signal and outputs the data signal together with a vertical synchronization signal, a horizontal synchronization signal, a data enable signal, and a clock signal. The image supply unit 110 supplies the vertical synchronization signal, the horizontal synchronization signal, the data enable signal, the clock signal, and the data signal to the timing controller 120 through a low voltage differential signaling (LVDS) interface or a transition minimized differential signaling (TMDS) interface.

The timing controller 120 receives a data signal DATA, and the like, from the image supply unit 110 and outputs a gate timing control signal GDC for controlling an operation timing of the scan driver 130 and a data timing control signal DDC for controlling an operation timing of the data driver 140.

The timing controller 120 outputs a data signal DATA together with the gate timing control signal GDC and the data timing control signal DDC through a communication interface, and controls an operation timing of the scan driver 130 and the data driver 140.

In response to the gate timing control signal GDC supplied from the timing controller 120, the scan driver 130 outputs a scan signal (or a gate signal), while shifting a level of a gate voltage. The scan driver 130 includes a level shifter and a shift register.

The scan driver 130 supplies a scan signal to sub-pixels SP included in the display panel 150 through scan lines GL1 to GLm. The scan driver 130 may be formed as an integrated circuit (IC) or formed in a gate-in-panel manner on the display panel 150. A part formed in the gate-in-panel manner in the scan driver 130 is the shift register.

In response to the data timing control signal DDC supplied from the timing controller 120, the data driver 140 samples and latches the data signal DATA, converts a digital signal into an analog signal according to a gamma reference voltage, and outputs the converted analog signal.

The data driver 140 supplies the data signal DATA to the sub-pixels SP included in the display panel 150 through data lines DL1 to DLn. The data driver 140 is formed as an integrated circuit (IC).

The power supply unit 180 generates and outputs voltages such as a first source voltage VDD, a second source voltage VCC, and a low potential voltage GND. The voltages output from the power supply unit 180 are discriminately supplied to the timing controller 120, the scan driver 130, the data driver 140, and the display panel 150.

In response to the scan signal supplied from the scan driver 130 and the data signal DATA supplied from the data driver 140, the display panel 150 displays an image. The display panel 150 includes sub-pixels SP.

As illustrated in FIG. 2, a single sub-pixel includes a switching thin film transistor (TFT) SW connected to the scan line GL1 and the data line DL1 (or formed in an intersection between the scan line GL1 and the data line DL1), and a pixel circuit PC operated in response to the data signal DATA supplied through the switching TFT SW. The sub-pixels SP are configured as a liquid crystal display panel including a liquid crystal element or an organic light emitting display panel including an organic light emitting element according to a configuration of the pixel circuit PC.

When the display panel 150 is configured as a liquid crystal display panel, the display panel 150 can be implemented in a twisted nematic (TN) mode, a vertical alignment (VA) mode, an in-plane switching (IPS) mode, a fringe field switching (FFS) mode, an electrically controlled birefringence (ECB) mode, or the like. When the display panel 150 is configured as an organic light emitting display panel, the display panel 150 can be implemented in a top-emission scheme, a bottom-emission scheme, or a dual-emission scheme.

The display device described above displays a specific image as the display panel 150 emits light or allows light to be transmitted therethrough on the basis of a voltage output from the power supply unit 180 and the scan signal and the data signal DATA output from the scan driver 130 and the data driver 140.

In the related art display device, when a voltage output from the power supply unit fluctuates significantly due to a variation in the load and when the degree of the voltage fluctuation differs depending on the variation of the load, a horizontal crosstalk (X-talk) may be generated on the display panel. In particular, when a large number of thin film transistors (TFTs) are formed for each sub-pixel, as in the case of OLED device, it may be more difficult to predict an amount of such a horizontal crosstalk generated in the display panel.

In order to solve the foregoing problem, a scheme of adding an output capacitor to an output terminal of the power supply unit has been proposed. However, the proposed scheme may be able to alleviate the foregoing problem by using a load capacitor, but may not completely eliminate the problem. In addition, the proposed scheme may increase the cost due to the addition of the load capacitor, and also, an effect thereof may not be sufficient depending on design schemes (type/size of a display panel, etc.) of the load.

Hereinafter, an apparatus and a method for improving the aforementioned problem will be described.

Figure 3:
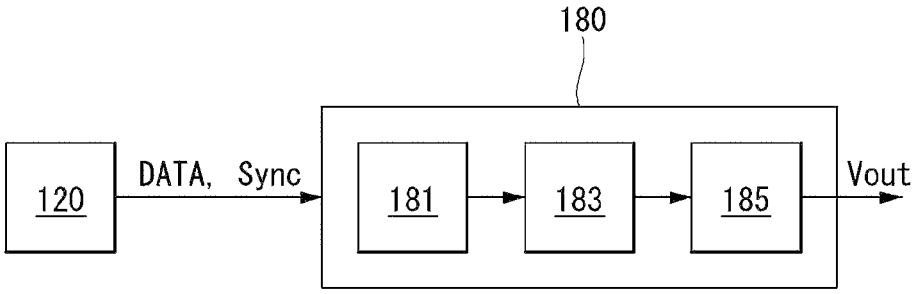
FIG. 3 is a view illustrating a configuration of a portion of a display device according to the first embodiment of the present disclosure.
Figure 4:
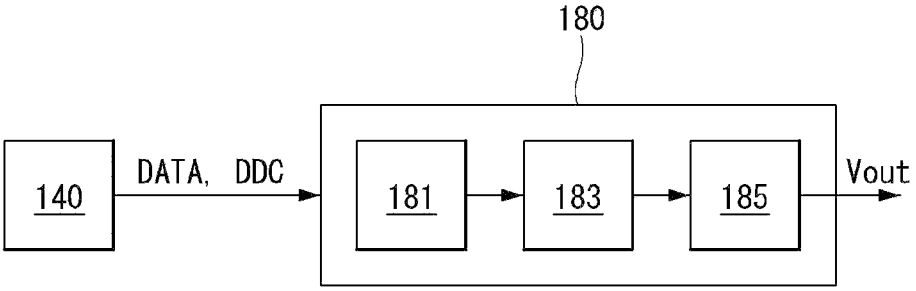
FIG. 4 is a view illustrating a configuration of a portion of a display device according to the second embodiment of the present disclosure.
Figure 5:
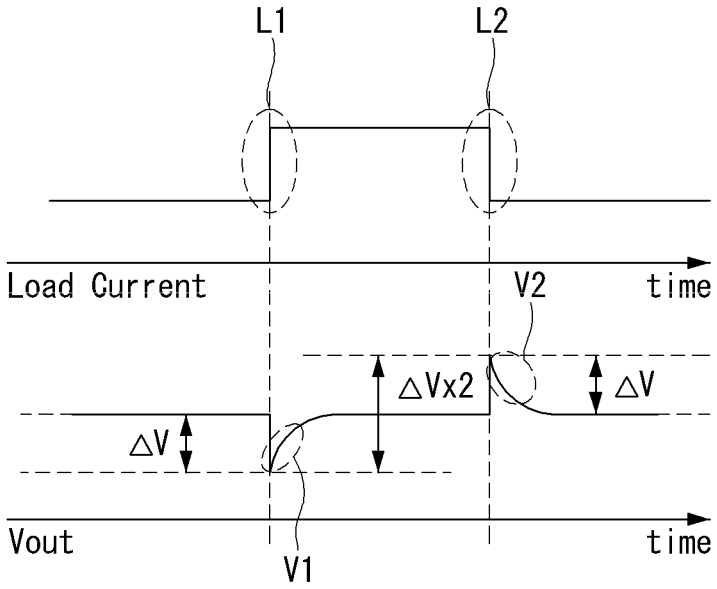
FIG. 5 is a waveform view illustrating a relationship between a load current and a power source according to the related art.
Figure 6:
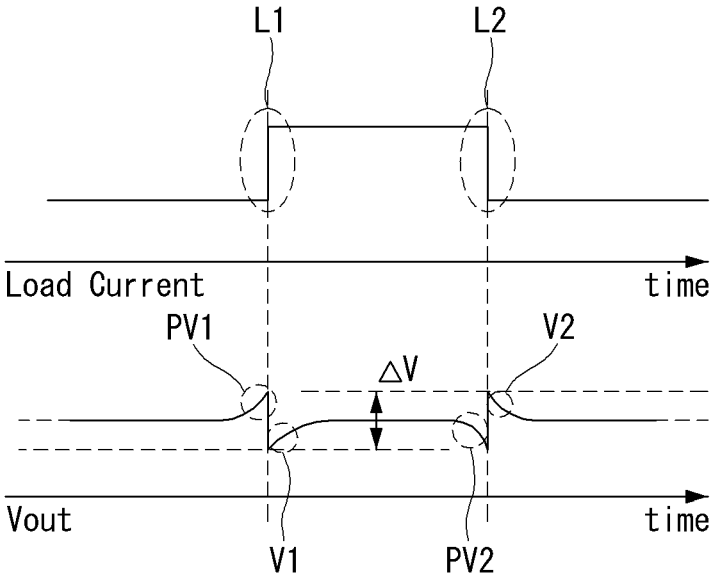
FIG. 6 is a waveform view illustrating a relationship between a load current and a power source according to an embodiment of the present disclosure.

FIG. 3 is a view illustrating a configuration of a portion of a display device according to the first embodiment of the present disclosure, FIG. 4 is a view illustrating a configuration of a portion of a display device according to the second embodiment of the present disclosure, FIG. 5 is a waveform view illustrating a relationship between a load current and a power source according to the related art, and FIG. 6 is a waveform view illustrating a relationship between a load current and a power source according to an embodiment of the present disclosure.

As illustrated in FIG. 3, in the first embodiment of the present disclosure, the timing controller 120 and the power supply unit 180 work together with each other. The power supply unit 180 varies a voltage Vout output therefrom on a basis of the data signal DATA and a synchronization signal Sync supplied from the timing controller 120.

In detail, the power supply unit 180 receives device information DATA and Sync in advance from the timing controller 120, and analyzes and predicts an amount of variation of the voltage Vout to be output from the power supply unit 180 on a basis of the received device information DATA and Sync. In order to reduce an amount of a transient voltage due to a change in a load, the power supply unit 180 varies the output voltage Vout on a basis of the predicted variation amount of the voltage Vout before the load is changed.

The power supply unit 180 includes a current amount analyzing unit 181, a variation amount determining unit 183, and an output voltage varying unit 185. Although not illustrated in FIG. 3, the power supply unit 180 may further include other circuit blocks (a communication interface, a control circuit, etc.).

On a basis of the data signal DATA supplied from the timing controller 120, the current amount analyzing unit 181 analyzes and predicts an output current amount according to the data signal DATA. The current amount analyzing unit 181 analyzes and predicts a transient current amount of the output voltage according to an output current amount. The current amount analyzing unit 181 delivers the analyzed and predicted transient current amount of the output voltage to the variation amount determining unit 183.

On a basis of the transient current amount of the output voltage delivered from the current amount analyzing unit 181, the variation amount determining unit 183 determines a variation amount of the output voltage according to the transient current amount. The variation amount determining unit 183 may configure the variation amount of the output voltage according to the transient current amount, in the form of a look-up table, or the like, from which the variation amount of the output voltage according to the transient current amount may be extracted and output according to a predetermined value. The variation amount determining unit 183 delivers the extracted variation amount of the output voltage to the output voltage varying unit 185.

On a basis of the data signal DATA and the synchronization signal Sync supplied from the timing controller 120 and the variation amount of the output voltage delivered from the variation amount determining unit 183, the output voltage varying unit 185 defines a transient current generation section (or a generation point in time). On a basis of the transient current generation section, the output voltage varying unit 185 varies the output voltage Vout of the power supply unit 180 before a transient voltage is generated (or before the load is changed).

As illustrated in FIG. 4, in the second embodiment of the present disclosure, the data driver 140 and the power supply unit 180 work together with each other. The power supply unit 180 varies the voltage Vout output therefrom on a basis of the data signal DATA and the data timing control signal DDC supplied from the data driver 140.

In detail, the power supply unit 180 receives device information DATA and DDC in advance from the data driver 140 and analyzes and predicts a variation amount of the voltage Vout to be output from the power supply unit 180 on a basis of the received device information DATA and DDC. In order to reduce an amount of a transient voltage due to a change in a load, the power supply unit 180 varies the output voltage Vout on a basis of the predicted variation amount of voltage before the load is changed.

The data timing control signal DDC includes a source start pulse (SSP), a source sampling clock (SSC), a polarity control signal POL, a source output enable signal SOE, and the like. The source start pulse is a signal for controlling a data sampling start point of the data driver 140. The source sampling clock is a signal for controlling a sampling operation of data within the data driver 140 with respect to a rising or falling edge. The polarity control signal is a signal for controlling a polarity of a data voltage. The source output enable signal is a signal for controlling an output of the data driver 140.

The data timing control signal DDC output from the data driver 140 may also include a signal capable of detecting a section in which a load is changed by the synchronization signal Sync output from the timing controller 120 (or a signal capable of synchronizing an output point of power).

Hereinafter, among signals output from the data driver 140, the data timing control signal DDC will be described as an example of a signal capable of recognizing a section in which a load is changed. However, a name or definition of a signal capable of detecting a section in which a load is changed may be varied.

The power supply unit 180 includes a current amount analyzing unit 181, a variation amount determining unit 183, and an output voltage varying unit 185. Although not illustrated in FIG. 4, the power supply unit 180 may further include other circuit blocks (a communication interface, a control circuit, etc.).

On a basis of the data signal DATA supplied from the data driver 140, the current amount analyzing unit 181 analyzes and predicts an output current amount according to the data signal DATA. The current amount analyzing unit 181 analyzes and predicts a transient current amount of the output voltage according to an output current amount. The current amount analyzing unit 181 delivers the analyzed and predicted transient current amount of the output voltage to the variation amount determining unit 183.

On a basis of the transient current amount of the output voltage delivered from the current amount analyzing unit 181, the variation amount determining unit 183 determines a variation amount of the output voltage according to the transient current amount. The variation amount determining unit 183 may configure the variation amount of the output voltage according to the transient current amount, in the form of a look-up table, or the like, from which the variation amount of the output voltage according to the transient current amount may be extracted and output according to a predetermined value. The variation amount determining unit 183 delivers the extracted variation amount of the output voltage to the output voltage varying unit 185.

On a basis of the data signal DATA and the data timing control signal DDC supplied from the data driver 140 and the variation amount of the output voltage delivered from the variation amount determining unit 183, the output voltage varying unit 185 defines a transient current generation section. On a basis of the transient current generation section, the output voltage varying unit 185 varies the output voltage Vout of the power supply unit 180 before a transient voltage is generated (or before the load is changed).

Meanwhile, in order to vary the output voltage Vout, a method of varying an input voltage applied to a reference voltage Ref of an error amplifier of a DC/DC conversion unit present within the power supply unit 180 may also be used.

Related Art Example

According to the conventionally proposed scheme, which is illustrated in FIG. 5, it may be difficult to directly vary the output voltage Vout output from the power supply unit depending on a change in the load current. As a result, the output voltage Vout output from the power supply unit may fluctuate in sections L1 and L2 in which the load current changes rapidly.

For example, the output voltage Vout output from the power supply unit has a voltage fall section V1 in which a level thereof falls ΔV to correspond to the first load section L1 in which the load current increases, and thereafter, maintains a normal level. In another example, the output voltage Vout output from the power supply unit has a voltage rise section V2 in which a level thereof rises by ΔV to correspond to the second load section L2 in which the load current decreases, and thereafter, maintains the normal level.

In the conventionally proposed scheme, due to the generation of the transient currents caused by the change in the load current as in the first load section L1 or the second load section L2, the output voltage Vout output from the power supply unit forms a transient voltage ΔV×2 and fluctuates (V1 and V2). As a result, when the output voltage Vout output from the power supply unit fluctuates significantly due to a change in the load and when the degree of the fluctuation varies depending on the variation in the load, a horizontal crosstalk (X-talk) may be generated in the display panel.

Embodiment

According to a driving scheme according to an embodiment of the present disclosure, which is illustrated in FIG. 6, the output voltage Vout output from the power supply unit can directly vary before the load current is changed, which may reduce or prevent the output voltage Vout output from fluctuating in the sections L1 and L2 in which the load current changes rapidly.

For example, the output voltage Vout output from the power supply unit has a voltage fall preventing section PV1 in which a voltage rises for a predetermined period of time in advance to cope with the generation of the first load section L1 in which the load current increases. Due to such a compensation voltage (e.g., the voltage fall preventing section PV1), a fall width of the voltage fall section V1 in which a voltage falls to correspond to the first load section L1 is reduced or improved (compensated or canceled out), and thereafter, the output voltage Vout output from the power supply unit maintains the normal level.

In another example, the output voltage Vout output from the power supply unit has a voltage rise preventing section PV2 in which a voltage falls during a predetermined period of time in advance to cope with the generation of the second load section L2 in which the load current decreases. Due to such a compensation voltage (e.g., the voltage rise preventing section PV2), a rise width of the voltage rise section V2 in which a voltage rises to correspond to the second load section L2 is reduced or improved (compensated or canceled out), and thereafter, the output voltage Vout output from the power supply unit maintains the normal level.

In the driving scheme according to the embodiment of the present disclosure, even when the transient currents are generated due to the changes in the load current as in the first load section L1 or the second load section L2, the output voltage Vout output from the power supply unit is compensated and canceled out in advance. As a result, the driving scheme according to the embodiment of the present disclosure may lower a generation amount (ΔV) of the transient voltage, compared with the conventionally proposed scheme.

As described above, in the driving scheme according to the embodiment of the present disclosure, a compensation operation of temporarily applying a pre-adjusted voltage for canceling out a variation of the load to the output terminal of the power supply unit is performed, which may reduce or prevent a horizontal crosstalk (X-talk) generated in the display panel.

Meanwhile, when a large number of thin film transistors (TFTs) are formed for each sub-pixel, as in the case of an OLED display, it may be difficult to predict an amount of such a horizontal crosstalk generated in the display panel. Also, such a horizontal crosstalk or an abnormal screen problem may be aggravated when it appears in a small display device (e.g., a mobile device or a smartphone). As a result, the above configuration according to the embodiment of the present disclosure may be more effective when applied to a small display device.

Figure 7:
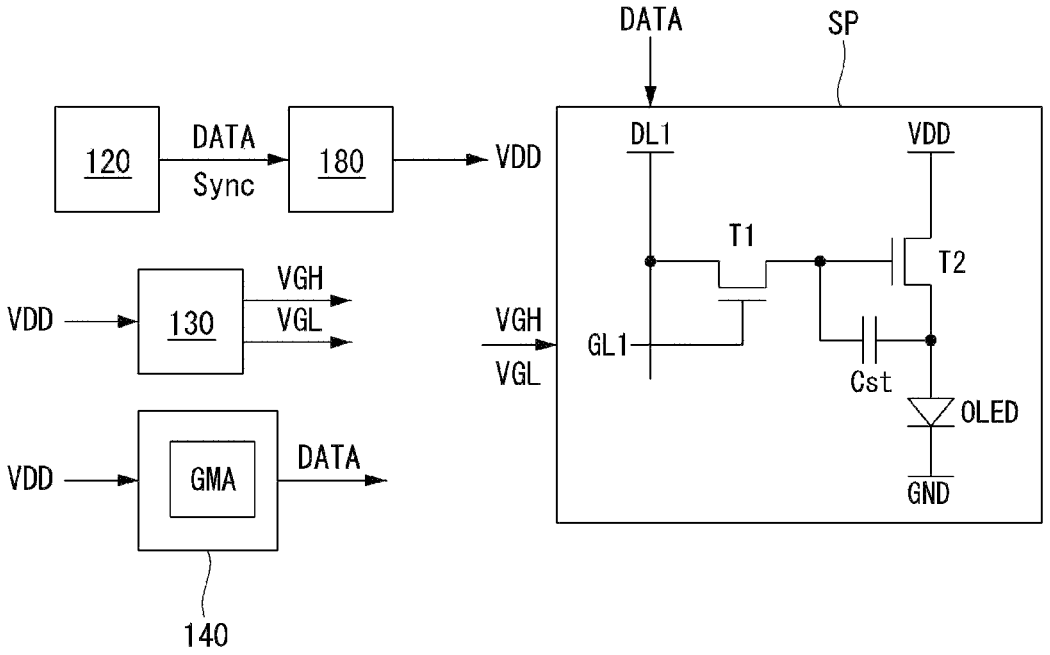
FIG. 7 is a view schematically illustrating a small organic light emitting display device employing the first embodiment of the present disclosure.

FIG. 7 is a view schematically illustrating a small OLED device employing the first embodiment of the present disclosure. A small OLED device, which has not been described but is described hereinafter, may also be applied to the second embodiment.

As illustrated in FIG. 7, the small OLED device may include a timing controller 120, a scan driver 130, a data driver 140, and a power supply unit 180. For ease of illustration, a single sub-pixel (SP) is described in the display panel.

In the small OLED device, the scan driver 130 and the data driver 140 operate on a basis of a first source voltage VDD output from the power supply unit 180. In detail, the scan driver 130 generates scan signals corresponding to a gate high voltage VGH and a gate low voltage VGL using a first source voltage VDD output from the power supply unit 180.

The data driver 140 uses the first source voltage VDD output from the power supply unit 180, as a reference voltage of a gamma unit GMA provided therein or outside, and converts a digital data signal into an analog data signal DATA according to the gamma reference voltage, and outputs the converted data signal.

The scan signals corresponding to the gate high voltage VGH and the gate low voltage VGL output from the scan driver 130 are supplied to a first transistor T of the sub-pixel SP through the scan line GL1. The data signal DATA output from the data driver 140 is stored as a data voltage in a capacitor Cst through the data line DL1 and the first transistor T1.

A second transistor T2 generates a driving current based on the data voltage stored in the capacitor Cst, and an OLED emits light in response to the driving current flowing through a first source voltage line VDD and a low potential voltage line GN.

In such a configuration, the scan signals corresponding to the gate high voltage VGH and the gate low voltage VGL periodically cause a change in the load according to 1 horizontal period H. Also, in the case of the data signal DATA, a charge amount (data voltage) charged in the capacitor Cst within the display panel varies on a basis of the horizontal period H. That is, the load change may include changes in both the scan line and the data line of the display panel. This is because the first source voltage VDD (voltage output from the power supply unit) supplied to the scan driver 130 and the data driver 140 according to 1 horizontal period can rapidly change.

When the output voltage of the power supply unit fluctuates or varies considerably due to a change in the load as in the conventionally proposed scheme, the drivers 130 and 140 operated on the output voltage from the power supply unit are also affected. As a result, when a small OLED device is implemented according to the conventionally proposed scheme, a horizontal crosstalk or an abnormal screen problem may be aggravated on the display panel.

On the other hand, in the small OLED device employing the first embodiment of the present disclosure, the power supply unit 180 performs a compensation operation in response to signals (DATA and Sync) output from the timing controller 120. As discussed above, the power supply unit 180 performs a compensation operation to vary the output voltage Vout to correspond to a variation of a load before the load is changed, which may reduce or prevent such a horizontal crosstalk or an abnormal screen problem from appearing on the display panel.

Hereinafter, a method for driving a display device according to an embodiment of the present disclosure will be described.

Figure 8:
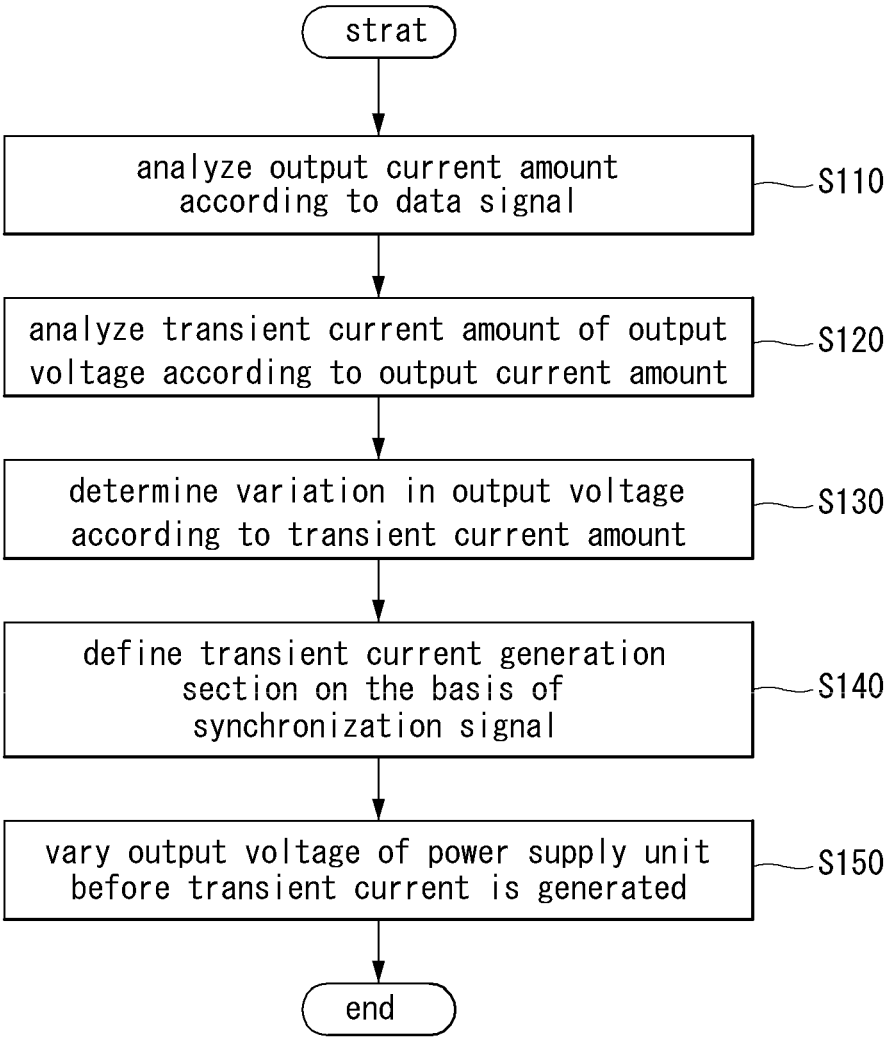
FIG. 8 is a flow chart illustrating a method for driving a display device according to an embodiment of the present disclosure.
Figure 9:
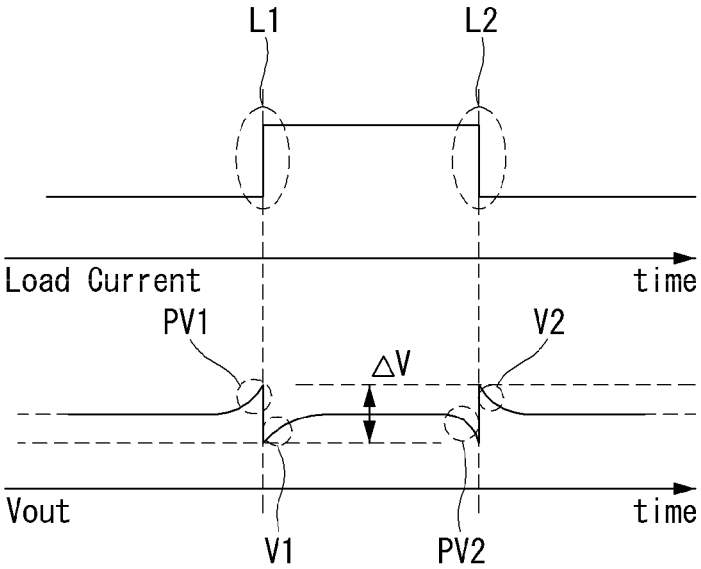
FIG. 9 is a waveform view illustrating a relationship between a load current and a power source according to the driving method of FIG. 8.
Figure 10:
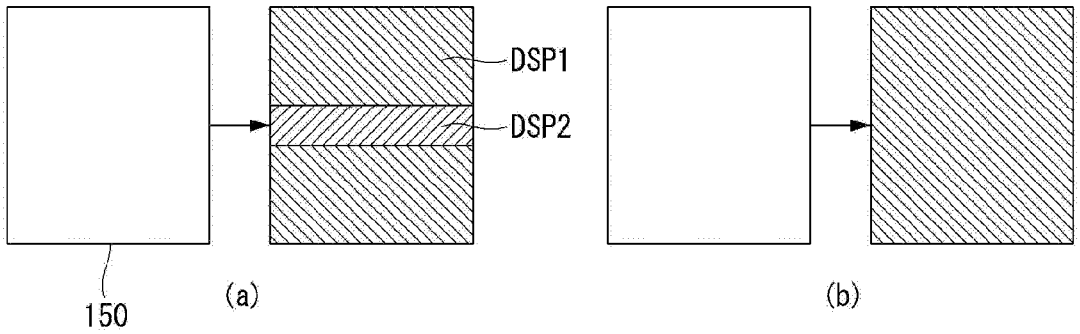
FIG. 10 is a view illustrating a comparison between a conventionally proposed scheme and an embodiment of the present disclosure.

FIG. 8 is a flow chart illustrating a method for driving a display device according to an embodiment of the present disclosure, FIG. 9 is a waveform view illustrating a relationship between a load current and a power source according to the driving method of FIG. 8, and FIG. 10 is a view illustrating a comparison between a conventionally proposed scheme and an embodiment of the present disclosure.

As illustrated in FIGS. 8 through 10, in a method for driving a display device according to an embodiment of the present disclosure, an output voltage output from a power supply unit is directly varied before a load current is changed. A flow of the driving method thereof will be described hereinafter.

First, an output current amount according to a data signal is analyzed (S110). The power supply unit analyzes and predicts a transient current amount of the output voltage according to an output current amount on a basis of a data signal supplied from a timing controller or a data driver. This may be performed by a current amount analyzing unit included in the power supply unit, but the present disclosure is not limited thereto.

Next, the transient current amount of the output voltage according to the output current amount is analyzed (S120). The power supply unit analyzes the transient current amount of the output voltage on a basis of the output current amount. This may be performed by a current amount analyzing unit included in the power supply unit, but the present disclosure is not limited thereto.

Thereafter, a variation of the output voltage according to the transient current amount is determined (S130). The power supply unit determines a variation of the output voltage according to the transient current amount on a basis of the transient current amount. This may be performed by a variation determining unit included in the power supply unit, but the present disclosure is not limited thereto.

Thereafter, a transient current generation section is defined on a basis of a synchronization signal (S140). The power supply unit defines the transient current generation section (or generation time) on a basis of a synchronization signal (or a control signal) supplied from the timing controller (or the data driver) and the variation of the output voltage. This may be performed by an output voltage varying unit included in the power supply unit, but the present disclosure is not limited thereto.

Thereafter, the output voltage of the power supply unit is varied before a transient current is generated (S150). The power supply unit varies the output voltage thereof on a basis of the synchronization signal (or the control signal) supplied from the timing controller (or the data driver) before a transient current is generated.

The output voltage output from the power supply unit is varied according to the foregoing driving scheme as follows.

For example, the output voltage Vout output from the power supply unit has a voltage fall preventing section PV1 (or a rise compensation voltage application section) in which a voltage rises for a predetermined period of time in advance to cope with the generation of the first load section L1 in which the load current increases. Due to the compensation voltage such as the voltage fall preventing section PV1, a fall width of the voltage fall section V1 in which a voltage falls to correspond to the first load section L1 is reduced or improved (compensated or canceled out), and thereafter, the output voltage Vout output from the power supply unit maintains a normal level.

In another example, the output voltage Vout output from the power supply unit has a voltage rise preventing section PV2 (or a fall compensation voltage application section) in which a voltage falls during a predetermined period of time in advance to cope with the generation of the second load section L2 in which the load current (or a transient current) decreases. Due to the compensation voltage such as the voltage rise preventing section PV2, a rise width of the voltage rise section V2 in which a voltage rises to correspond to the second load section L2 is reduced or improved (compensated or canceled out), and thereafter, the output voltage Vout output from the power supply unit maintains a normal level.

In the scheme according to the embodiment of the present disclosure, even when the transient currents are generated due to the changes in the load current as in the first load section L1 or the second load section L2, the output voltage Vout output from the power supply unit is compensated and canceled out in advance. As a result, the driving scheme according to the embodiment of the present disclosure may lower a generation amount ($\Delta V$) of the transient voltage, compared with the conventionally proposed scheme.

In the conventionally proposed scheme, as illustrated in (a) of FIG. 10, when a load current changes, for example, rapidly, a horizontal crosstalk (X-talk) or an abnormal screen problem (e.g., a difference in brightness between DSP1 and DSP2 or flickering) appears on the display panel 150.

In contrast, in the driving scheme according to the embodiment of the present disclosure, as illustrated in (b) of FIG. 10, even when a load current changes, for example, rapidly, a horizontal crosstalk (X-talk) or an abnormal screen problem that would appear on the display panel 150 can be reduced or prevented.

As described above, according to an embodiment of the present disclosure, transient current characteristics of an output voltage can be improved by reducing a fluctuation of the voltage due to a change in the load, thus enhancing display quality. Also, since an embodiment of the present disclosure can reduce a horizontal crosstalk (X-talk), a capacity of an output capacitor of a circuit block (e.g., DC/DC conversion unit) added to improve the horizontal crosstalk (X-talk), can be reduced and thus, the manufacturing cost can also be reduced.

It will be apparent to those skilled in the art that various modifications and variation can be made in the present invention without departing from the concepts and scope of the invention. Thus, it is intended that the present invention cover the modifications and variations of this invention provided they come within the scope of the appended claims and their equivalents.

What is claimed is:

1. A display device comprising:

a display panel that displays an image;

a driver including a data driver and a scan driver that drive the display panel;

a power supply unit that supplies an output voltage to the driver; and a timing controller that receives an image data signal and controls an operational timing of the data and scan drivers, wherein the power supply unit performs a compensation operation to vary the output voltage output therefrom to correspond to a variation of a load on a basis of the image data signal, and wherein the power supply unit performs the compensation operation on a basis of the image data signal and a data timing control signal supplied from the data driver to gradually vary the output voltage starting before the variation of the load, the power supply unit further comprising:

a current amount analyzing unit that analyzes and predicts an output current amount according to the image data signal; and a variation determining unit that determines a variation in an output voltage according to a transient current amount of the output voltage transferred from the current amount analyzing unit.

2. The display device of claim 1, wherein the power supply unit temporarily applies the output voltage for canceling out the variation in the load to an output terminal thereof before the load changes.

3. The display device of claim 1, wherein the power supply unit applies a rise compensation voltage for reducing a voltage fall before a first load section in which a load current increases is generated, and applies a fall compensation voltage for reducing a voltage rise before a second load section in which the load current decreases is generated.

4. The display device of claim 1, wherein the power supply unit comprises:

an output voltage varying unit that defines a transient current generation section on a basis of the image data signal and the data timing control signal, and the variation in the output voltage transferred from the variation determining unit, and vary the output voltage output therefrom to correspond to the variation in the load before the load changes.

5. The display device of claim 4, wherein the output voltage varying unit includes a look-up table for extracting and outputting a variation in the output voltage according to the transient current amount of the output voltage transferred from the current amount analyzing unit, to correspond to a predetermined value.

6. A method for driving a display device, the method comprising:

analyzing and predicting an output current amount according to an image data signal supplied from a data driver;

analyzing a transient current amount of an output voltage according to the output current amount;

determining a variation in the output voltage according to the transient current amount;

defining a transient current generation section on a basis of the variation in the output voltage; and gradually varying the output voltage of a power supply unit starting before a transient current is generated, wherein the transient current generation section is defined on a basis of the variation in the output voltage and a data timing control signal supplied from the data driver.

7. The method of claim 6, wherein, in varying the output voltage, a voltage for canceling out the transient current amount is temporarily applied to an output terminal of the power supply unit before the transient current is generated.

8. The method of claim 6, wherein, in varying the output voltage, a compensation operation is performed to apply a rise compensation voltage for reducing a voltage fall before a first load section in which a transient current increases is generated, and to apply a fall compensation voltage for reducing a voltage rise before a second load section in which a transient current decreases is generated.

9. A display device comprising:

a display panel that displays an image;

a driver including a data driver and a scan driver that drive the display panel;

a power supply unit that supplies an output voltage to the driver; and a timing controller that receives an image data signal and controls an operational timing of the data and scan drivers, wherein the power supply unit performs a compensation operation to vary the output voltage output therefrom to correspond to a variation of a load on a basis of the image data signal, and wherein the power supply unit performs the compensation operation on a basis of the image data signal and a data timing control signal supplied from the data driver, wherein the power supply unit gradually varies the output voltage for canceling out the variation in the load to an output terminal thereof starting before the load changes.

* * * * *